US006494660B1

(12) United States Patent
Duschek et al.

(10) Patent No.: US 6,494,660 B1
(45) Date of Patent: Dec. 17, 2002

(54) METHOD AND DEVICE FOR PRODUCING SECURITY ELEMENTS FOR ELECTRONICALLY SECURING GOODS AND A CORRESPONDING SECURITY ELEMENT

(75) Inventors: Detlef Duschek, Sensbachtal (DE); Gordon Klassen, Duarte, CA (US)

(73) Assignee: Meto International GmbH, Hirschhorn (DE)

( * ) Notice: Subject to any disclaimer, the term of this patent is extended or adjusted under 35 U.S.C. 154(b) by 0 days.

(21) Appl. No.: 09/423,871

(22) PCT Filed: Apr. 30, 1998

(86) PCT No.: PCT/EP98/02544

§ 371 (c)(1),
(2), (4) Date: Nov. 15, 1999

(87) PCT Pub. No.: WO98/52171

PCT Pub. Date: Nov. 19, 1998

(30) Foreign Application Priority Data

May 15, 1997 (DE) ..... 197 20 319

(51) Int. Cl.[7] ..... B42B 9/00
(52) U.S. Cl. ..... 412/1; 283/67; 283/82
(58) Field of Search ..... 412/1, 3, 6, 8, 412/9, 11, 12, 13, 14; 283/67, 72, 82; 340/572.1, 572.3, 572.6; 156/297; 428/900

(56) References Cited

U.S. PATENT DOCUMENTS 5,246,522 A 9/1993 Cordery et al.
5,355,120 A 10/1994 Ferguson et al.
5,602,528 A 2/1997 Witchger
5,909,177 A * 6/1999 Ruhrig ..... 340/572.1

FOREIGN PATENT DOCUMENTS

DE 3244430 A1 11/1984
EP 0319248 A2 6/1989
EP 0737949 A1 10/1996

* cited by examiner

*Primary Examiner*—William Fridie, Jr.
(74) *Attorney, Agent, or Firm*—Jones, Tullar & Cooper, P.C.

(57) ABSTRACT

The present invention is directed to a method and a device for the production of security elements for electronic article surveillance, the security elements being comprised of at least two layers, as well as to a web material manufactured by means of said method.

The present invention proposes a simple, economical method, a corresponding device for the production of web material, as well as a web material manufactured by the method for the purposes of electronic article surveillance.

With regard to the method the present invention is accomplished in that sections of a predetermined length cut from a second material web are conveyed in a direction transverse to the running direction (x) of a first continuous material web and are applied to the first material web.

3 Claims, 3 Drawing Sheets

FIG.2
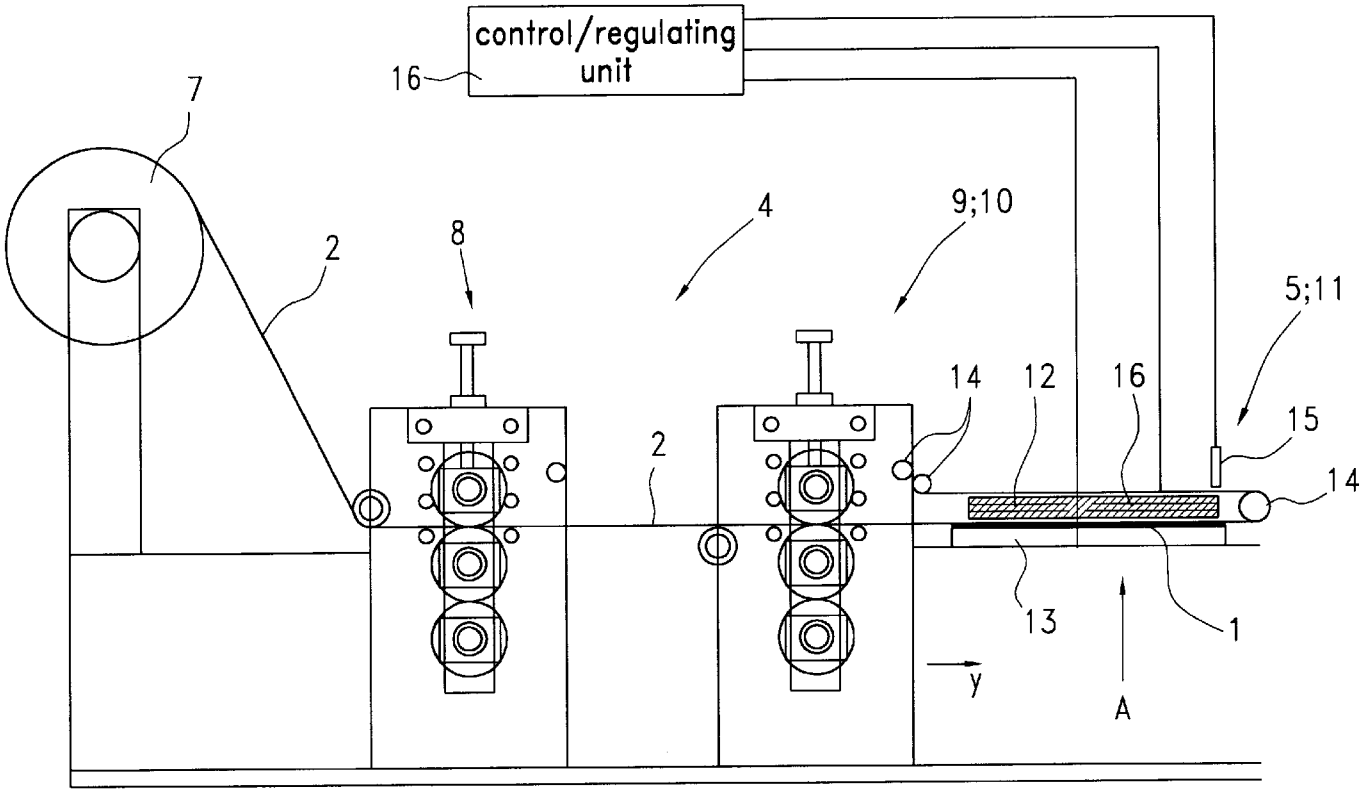
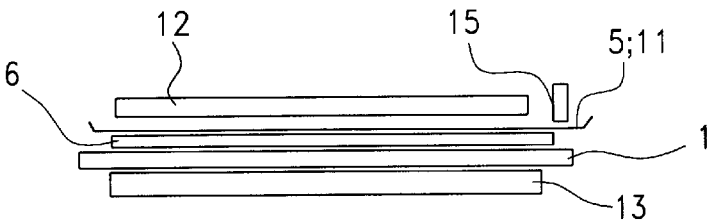
FIG.2a

METHOD AND DEVICE FOR PRODUCING SECURITY ELEMENTS FOR ELECTRONICALLY SECURING GOODS AND A CORRESPONDING SECURITY ELEMENT

FIELD OF THE INVENTION

This invention relates to a method and a device for the production of security elements for electronic article surveillance as well as to a corresponding security element, one security element being comprised of at least two layers.

BACKGROUND OF THE INVENTION

The goods in department stores and warehouses are being protected from theft increasingly by electronic devices. One way to guard against theft by electronic surveillance is to attach strip elements, meaning elongate soft magnetic pieces of metal (e.g., VITROVAC from the Vacuumschmelze company), to the goods. These strip elements trigger an alarm when present in corresponding monitoring systems, which are usually positioned in the exit area of the facility to be protected.

Electronic article surveillance can be described roughly as follows: A monitoring system has a transmitting device and a receiveing device. The transmitting device transmits an interrogating signal into a monitoring zone. This interrogating signal excites the strip element into transmitting a reply signal which is detected and identified by the receive device. The occurrence of a reply signal is equated with the unauthorized passing of an electronically protected article through the interrogation zone, and the alarm is triggered. An example of such a monitoring system is described in European Patent EP 0 123 586 A1.

Resonant security elements are used in addition to the strip-shaped security elements for electromagnetic article surveillance. These resonant security elements are comprised of a resonant circuit having capacitive and inductive elements. As soon as such a resonant circuit is exposed to a corresponding electromagnetic field insided an interrogation zone it transmits a reply signal with its resonant frequency.

SUMMARY OF THE INVENTION

It is an object of the present invention to provided a simple, economical method, a corresponding device and a web material manufactured by the method for the purposes of electronic article surveillance.

The object of the present with regard to the method is accomplished in that sections of a second web material cut to a predetermined length are conveyed in a direction transverse to the running direction of a first continuous material web and are applied to the first material web. An application example of web materials produced in this manner follows below.

The previously mentioned strip elements for electronic article surveillance come in a length of several centimeters (e.g., 3 cm). Labels, each containing one strip element, are conventionally provided in the form of a roll of labels and dispensed by means of suitable dispensing devices. If—as is usual—the strip elements measuring several centimeters in length are wound up in the longitudinal direction to a roll of labels, one roll of labels will contain relatively few labels. The picture is quite different, however, if the strip elements are wound up in the transverse direction to the dispensing direction. It is then possible to materially increase the number of strip elements per roll of labels.

The transverse arrangement of the strip elements affords particular advantages when it is considered how these strip elements are normally produced: A relatively wide soft magnetic endless strip is produced; this endless strip is subsequently split into several soft magnetic endless strips lying in side-by-side arrangement. A label applied from the side to the first material web thus contains several parallel strip elements. This way it is possible to achieve a further notable reduction in the production costs for label rolls containing strip elements.

According to a further application example, sections cut from a thin-film material are applied to an endless strip made of thin-film material (materials of this type are described in detail in European Patent EP 0 295 028). For production-related reasons, thin-film materials display a preferential direction, i.e., the reply signal is at its maximum level when the interrogation field is oriented parallel to this preferential direction but is at zero level when the angle of incidence is perpendicular to the preferential direction. If two layers of thin-film materials are arranged perpendicular to each other, the security element in question will always be excited into transmitting a reply signal regardless of its orientation in the interrogation zone.

The method of the present invention is characterized in that according to an advantageous further aspect the sections of predetermined length cut from the second material web can be applied to the first material web in steps or continuously. The advantage of the continuous method is, of course, the higher production rate.

The object of the present invention with regard to the device is accomplished in that a guide device is provided for a first material web, at least one dispensing device for feeding the sections of a predetermined length cut from a second material web is provided at right angles to the guide device, and a conveying device is provided to take successively from the dispensing device those sections of predetermined length cut from the second material web and affix them to the first material web either directly a side by side a or with a gap in between.

While in use of just a single dispensing device the sections are applied to the first material web in steps, with two or more dispensing devices a it is possible for the device of the present invention to work continuously. All that is necessary in this case is for there to be a certain distance between each of the n dispensing devices and for the sections to be fed at a rate coordinated with the running speed of the first material web. The rate at which the sections are fed has to be set at least high enough for a section to be in the correct "ready" position as soon as that area of the first material web is reached where the section is to be applied.

According to an advantageous further aspect of the device of the present invention, provision is made for the dispensing device to be a conveyor belt, for at least one electromagnet to be positioned in the inner space formed by the revolving conveyor belt, for at least one further electromagnet to be provided in the area underneath the first material web where the sections of the second material web are to be applied to the first material web, and for a control/regulating unit to be provided to switch the electromagnets on and off so that the sections of the second material web are applied to the first material web.

Furthermore, in accordance with a favorable embodiment of the device of the present invention the following is proposed: A stop or a sensor for detecting the correct position of the section of the second material web relative to the first material web is arranged in the end zone of the conveying device; the control/regulating unit switches the first electromagnet off and the second electromagnet on as soon as the stop or the sensor signals that the section of predetermined length cut from the second material web has reached the predetermined position relative to the first material web.

According to an advantageous further aspect of the device of the present invention, provision is made for n dispensing devices arranged at a relative distance of (2n+1)*(b+z), where b is the width of the sections of the second material web, and z the desired distance between two consecutive sections of the second material web. This embodiment permits the n dispensing devices to work parallel to each other, i.e., without time off-set. Obviously, the control effort is thus reduced considerably.

The advantages of a further aspect of the device of the present invention, which involve the setting of the running speed of the first material web so that the sections of predetermined length of the second material web are applied to the first material web in a continuous process, have already been mentioned in the foregoing.

Advantageously, provision is made for a take-up reel onto which the finished web material is wound.

The object of the present invention with regard to the security element is accomplished in that the first material web is a continuous material web to which the sections of a predetermined length cut from a second material web made of a magnetic material are conveyed in a direction transverse to the running direction (x) of the first material web and applied thereto.

Preferably, the first material web is a substrate; and sections of a predetermined length cut from the second material web are adhesive labels, each containing at least one security element for electronic article surveillance.

Alternatively, the security elements are a plurality of deactivatable or non-deactivatable strip elements arranged parallel to each other and in a direction transverse to the running direction (x) of the first material web.

A further embodiment of the security element of the present invention provides for the first material web to be a thin-film material whose preferential direction extends transverse or parallel to the running direction (x) of the first material web, and for the sections of predetermined length (x) cut from the second material web to be equally thin-film labels whose preferential direction extends respectively parallel or transverse to the running direction (x) of the first material web.

Similarly, it is possible for the sections of a predetermined length cut from the second material web to be resonant labels.

BRIEF DESCRIPTION OF THE DRAWINGS

The present invention will be explained in more detail in the following with reference to the accompanying drawings. In the drawings;

FIG. 2 is a longitudinal sectional view of the dispensing device of FIG. 1;

FIG. 2*a* is a view, to an enlarged scale, of detail A of FIG. 2; and

DESCRIPTION OF THE PREFFERRED EMBODIMENT

Figure 1:
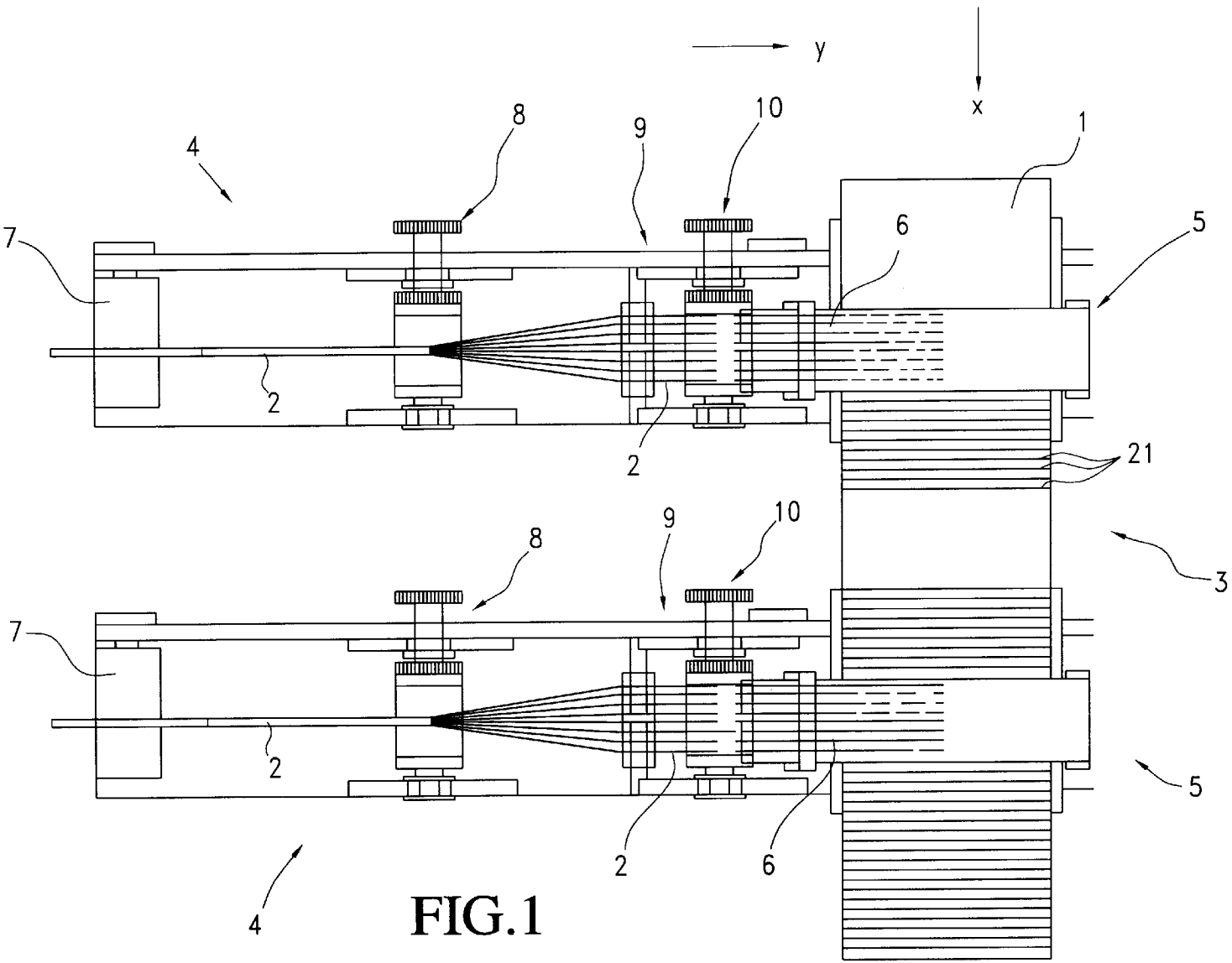
FIG. 1 is a top plan view of an embodiment of the device of the present invention.

FIG. 1 shows a top plan view of an embodiment of the device of the present invention. FIG. 2 shows a longitudinal section of a conveying device 4 and a cross section of a, guide device 3.

In the embodiment shown, a material web 2 is a soft magnetic strip from which elements referred to as strip elements for electronic article surveillance are made. A material web 2 is unwound a supply reel 7 and divided in a longitudinal cutting unit 8 into strips of a desired width. A web material 2, which has been divided into individual strips, is then fanned out in a fanning unit 9 so that the individual strips are a desired distance apart, after which they are cut in a cross cutting unit 10 into sections 6 of desired length (x). The adjacent lying soft magnetic strips of predetermined length (x) are picked up by a conveyor belt 11 and transferred over a, cross-running material web 1. Feeding the sections 6 of strip elements over the material web 1 is performed by an electromagnet 12 FIG. 2 arranged in the interior of the conveyor belt 11, which is guided around guide rollers 14. During this transfer cycle the electromagnet 12 is consequently activated. As soon as the section 6 with the strip elements has reached the correct position relative to the first material web 1—this information is received by the control/regulating unit 16 from a sensor 15—the control/regulating unit 16 switches off the electromagnet 12 and activates the electromagnet 13 arranged underneath a first material web 1. A sections 6 with strip elements are applied to the adhesive side of an material web 1 through the force of magnetic attraction. As soon as the section 6 with strip elements applied to the material web 1 is moved through underneath the dispensing device 4, a electromagnet 13 is switched off again.

Figure 3:
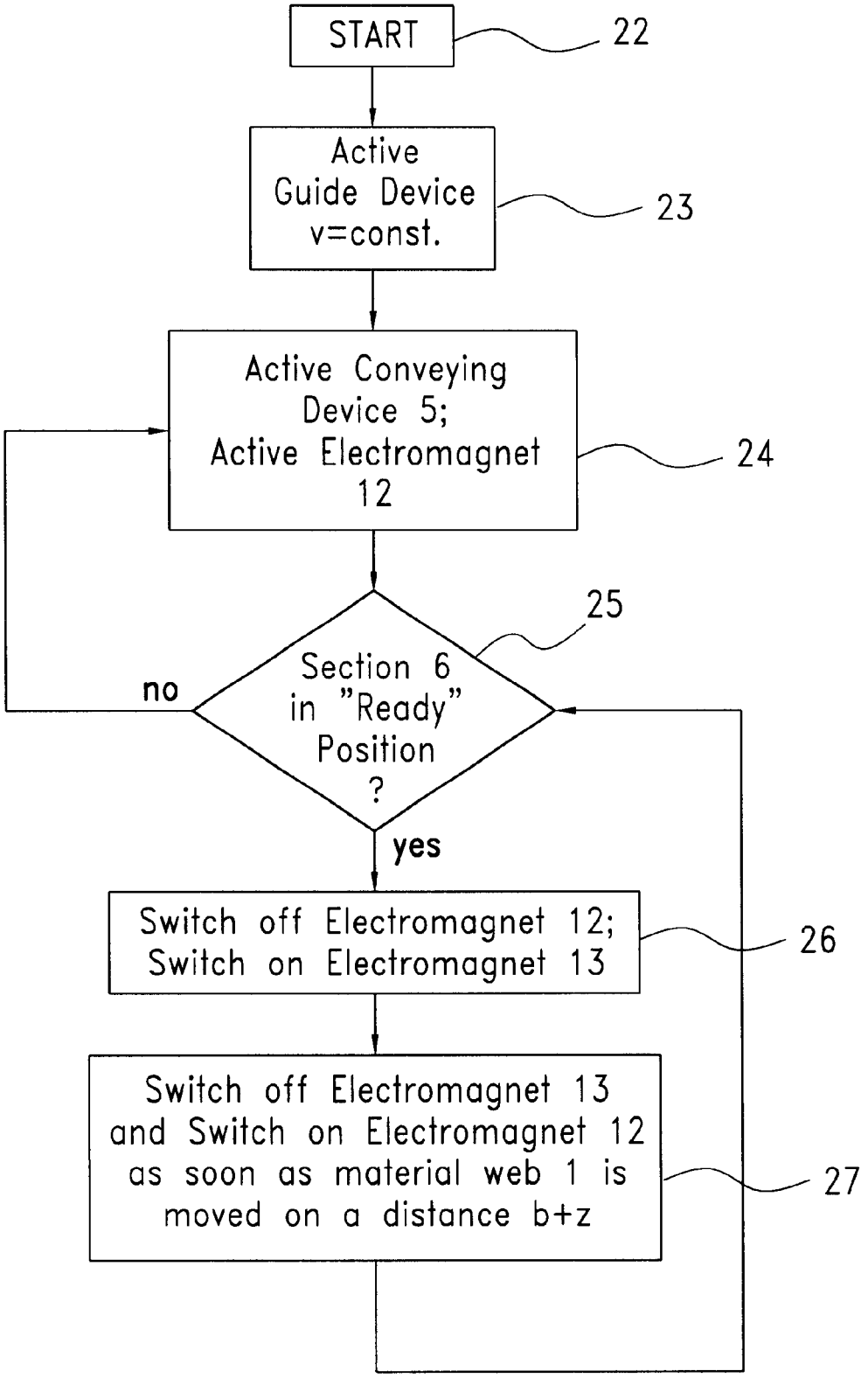
FIG. 3 is a flow diagram for controlling the control/regulating unit.

FIG. 3 shows a flow diagram for controlling the control/regulating unit 16. The program is started at 22. The guide device 3 for the first material web 1 is activated in program point 23. At the same time the conveying device 4 for feeding the sections 6 and the electromagnet 12 are activated. The electromagnet remains activated until the section 6 has reached the "ready" position, meaning the correct position relative to the material web 1. This check is performed at program point 25. As soon as the correct "ready" position of the section 6 is reached, the electromagnet 12 is switched off at program point 26 while the electromagnet 13 is switched on. The section 6 is applied by force of magnetic attraction to the adhesive side of the material web 1. The application operation is repeated in cycles as soon as the material web 1 is moved on a distance of at least 1+z.

What is claimed is:

1. A method for the production of security elements for electronic article surveillance, the security elements comprising at least two layers, the method comprising the steps of:

providing a first continuous web material;

providing a second web material;

providing a guide device for the first continuous web material;

providing at least one dispensing device for the second web material at right angles to the guide device;

establishing a running direction for the first continuous web material;

cutting the second web material into strips of predetermined width and then into sections of predetermined length;

conveying the sections cut into a direction transverse to said running direction; and applying the sections to the first continuous web material.

2. The method as defined in claim 1, wherein said conveying step is performed in steps.

3. The method as defined in claim 1, wherein said conveying step is performed continuously.

* * * * *